United States Patent [19]

Demichel

[11] Patent Number: 5,060,375

[45] Date of Patent: Oct. 29, 1991

[54] METHOD AND DEVICE FOR RIVETING A SHROUD TO THE TIPS OF ROTOR BLADES

[75] Inventor: Marcel Demichel, Sarcelles, France

[73] Assignee: GEC Alsthom SA, Paris, France

[21] Appl. No.: 512,240

[22] Filed: Apr. 20, 1990

[30] Foreign Application Priority Data

Apr. 21, 1989 [FR] France ..... 8905354

[51] Int. Cl.[5] ..... B21S 15/02

[52] U.S. Cl. ..... 29/889.21; 29/243.54; 29/889.22; 29/889.7; 72/453.19

[58] Field of Search ..... 29/889.7, 243.53, 243.54, 29/281.1, 889.21, 889.22; 72/453.19, 316, 318, 447

[56] References Cited

U.S. PATENT DOCUMENTS

| | | | |
|---|---|---|---|
| 2,135,040 | 11/1938 | Morgan et al. | 29/243.54 |
| 2,197,334 | 4/1940 | Bohan | 253/77 |
| 4,137,620 | 2/1979 | Beusing | 29/243.53 |
| 4,437,213 | 3/1984 | Reese et al. . | |
| 4,762,261 | 8/1988 | Hawly et al. | 29/243.53 |
| 4,864,702 | 9/1989 | Speller, Sr. et al. | 29/243.54 |
| 4,885,836 | 12/1989 | Bonomi et al. | 29/243.54 |

FOREIGN PATENT DOCUMENTS

| | | |
|---|---|---|
| 3535761 | 3/1987 | Fed. Rep. of Germany . |
| 2367553 | 5/1978 | France . |

*Primary Examiner*—Irene Cuda

*Attorney, Agent, or Firm*—Sughrue, Mion, Zinn, Macpeak & Seas

[57] ABSTRACT

A method and device for rivetting a shroud to the blades of a rotor stage of a rotor, each blade having one or more tenons adapted to be inserted into one or more holes in the shroud. The tenons are at an angle to the median plane of the rotor stage. A rivetting head is positioned in line with the tenon to be rivetted and held in place by two flanges between which the group of blades is clamped. The head then moves into alignment with another tenon along a circular arc or laterally. The method and device enable regular repetitive rivetting without any medical or legal restrictions.

11 Claims, 5 Drawing Sheets

METHOD AND DEVICE FOR RIVETING A SHROUD TO THE TIPS OF ROTOR BLADES

BACKGROUND OF THE INVENTION

1. Field of the invention

The present invention concerns a method and a device for rivetting a shroud to the blades of one stage of a rotor in order to bind them together, each blade comprising at its tip one or more tenons adapted to be inserted into one or more holes in the shroud, said tenons being at an acute angle c to the median plane of the rotor stage orthogonal to the axis of the rotor.

2. Description of the Prior Art

The patent U.S. Pat. No. 4 437 213 describes an automatic method of rivetting a shroud to a turbine rotor stage with radial tenons in which the rotor stage is moved in front of a rivetting head which is advanced and then retracted radially after each rivetting operation. This method is not usable if the tenons are at an angle to the plane of the rotor stage as the blades would be deformed by rivetting and the latter could not take place. This is why rivetting is currently carried out manually using a pneumatic gun or any equivalent impact device.

A method of this kind cannot produce consistently reproducible rivetting and its use is subject to specific constraints regarding legal provisions as to noise levels.

SUMMARY OF THE INVENTION

The method in accordance with the invention enabling regular, repetitive rivetting and that is not subject to any medical or legal restrictions characterized in that a rivetting head is set up for a specific rotor stage so that it can move in a circular manner in the vicinity of the tips of the rotor stage blades and so that when it is over a tenon its axis is aligned with the axis of the tenon, the following rivetting operations being then carried out:

- a first tenon is centered in front of the rivetting head,
- the rivetting head is clamped against vertical and horizontal movement,
- a group of blades including the blade to be shrouded by the rivetting head is clamped together,
- the shroud is clamped against the tip of the blade,
- the tenon is rivetted,
- the shroud and the group of blades are unclamped,
- the rivetting head is unclamped to allow vertical and horizontal movement,
- the rivetting head is moved to bring a second tenon in front of the rivetting head,
- the rivetting operations are repeated, and so on until all of the tenons of a shroud have been treated in this manner.

In another aspect, the invention consists in a device for rivetting a shroud to blades of a rotor stage of a rotor to bind them together, each blade comprising at its tip one or more tenons adapted to be inserted into one or more holes in said shroud, said tenons being at an acute angle c to the median plane of the rotor stage orthogonal to the rotor axis, said device comprising a carriage supporting a rivetting head, having a rivetting tool adapted to come into contact with the tenon and to be moved about the axis of the head to rivet the shroud by flattening the tenon, the axis of the rivetting head being coincident with the axis of the tenon, the rivetting head being fastened to flanges parallel to the axis of the rivetting head, each flange terminating in a part parallel to the plane P, each of these parts carrying a jaw and means for moving the jaw to immobilize a group of blades including the blade to which the shroud is to be rivetted.

The flanges fixed to the rivetting head are interchangeable and are used only for tenons having a specific inclination to the axis of the blade, that is to say with the vertical plane orthogonal to the axis of the rotor, which is horizontal.

The flanges have vertical end parts which carry jaws which immobilize the group of blades.

The rivetting head has an end-piece and an actuator which applies the end-piece against the shroud so as to hold it against the blade during rivetting.

The present invention will be better understood from the following description given by way of nonlimiting example only and with reference to the appended diagrammatic drawings.

DETAILED DESCRIPTION OF THE INVENTION

Figure 2:
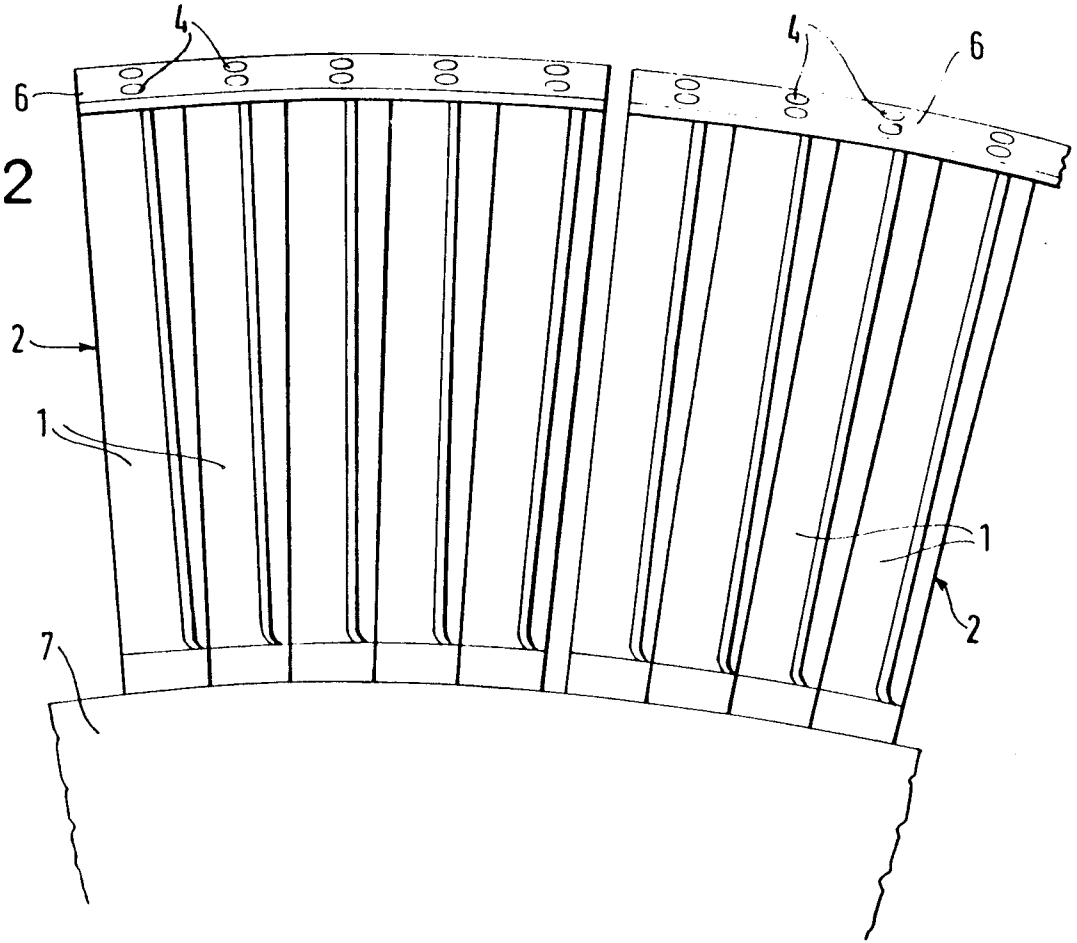
FIG. 2 shows a group of blades with its shroud.
Figure 1:
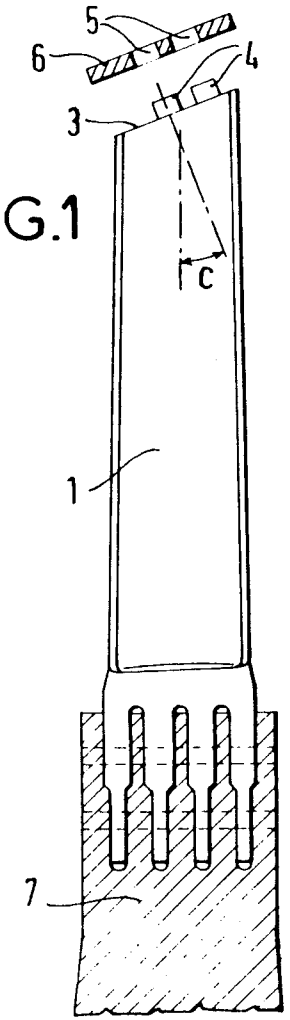
FIG. 1 shows a blade with its shroud.

FIG. 1 shows a blade 1 forming part of a group 2 of blades (see FIG. 2) in which each blade has at its tip 3 a plurality of tenons 4. The tenons 4 are adapted to be inserted into holes 5 in a shroud 6.

The tenons 4 are at a specific angle c to the vertical plane of symmetry of a rotor stage 7.

Figure 3:
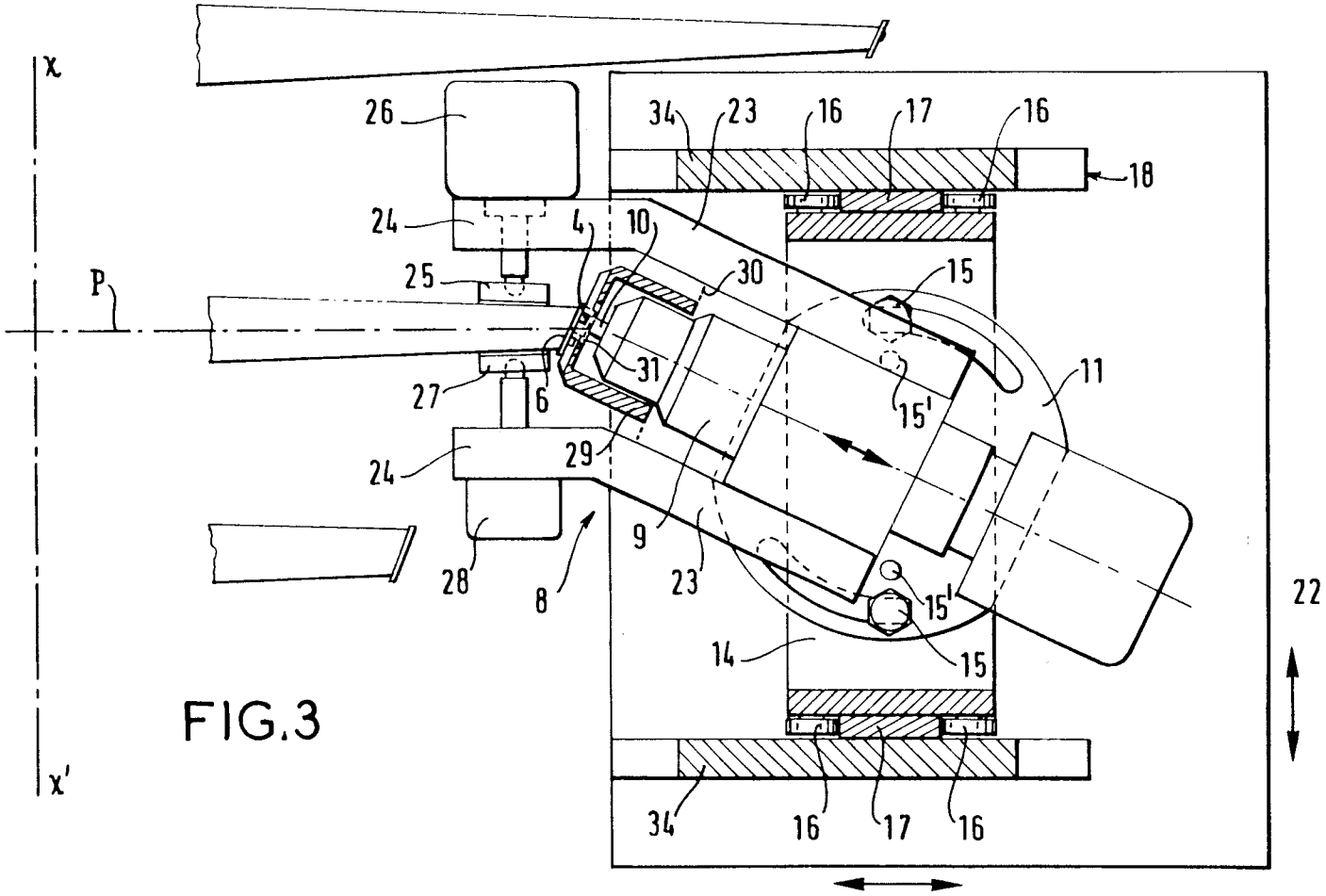
FIG. 3 is a partial plan cross-section of the rivetting device in accordance with the invention.
Figure 4:
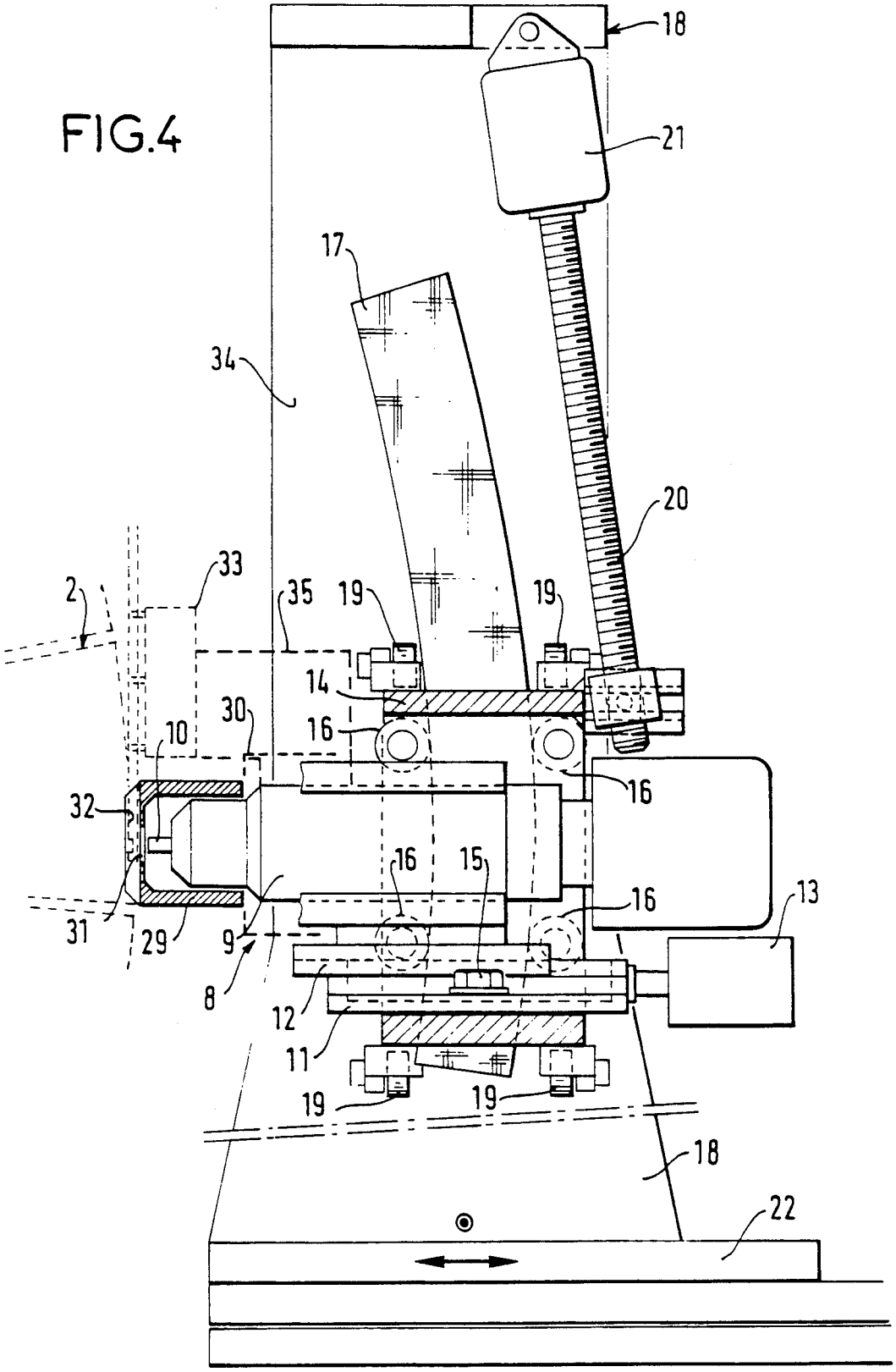
FIG. 4 is a side view of the device from FIG. 3.
Figure 5:
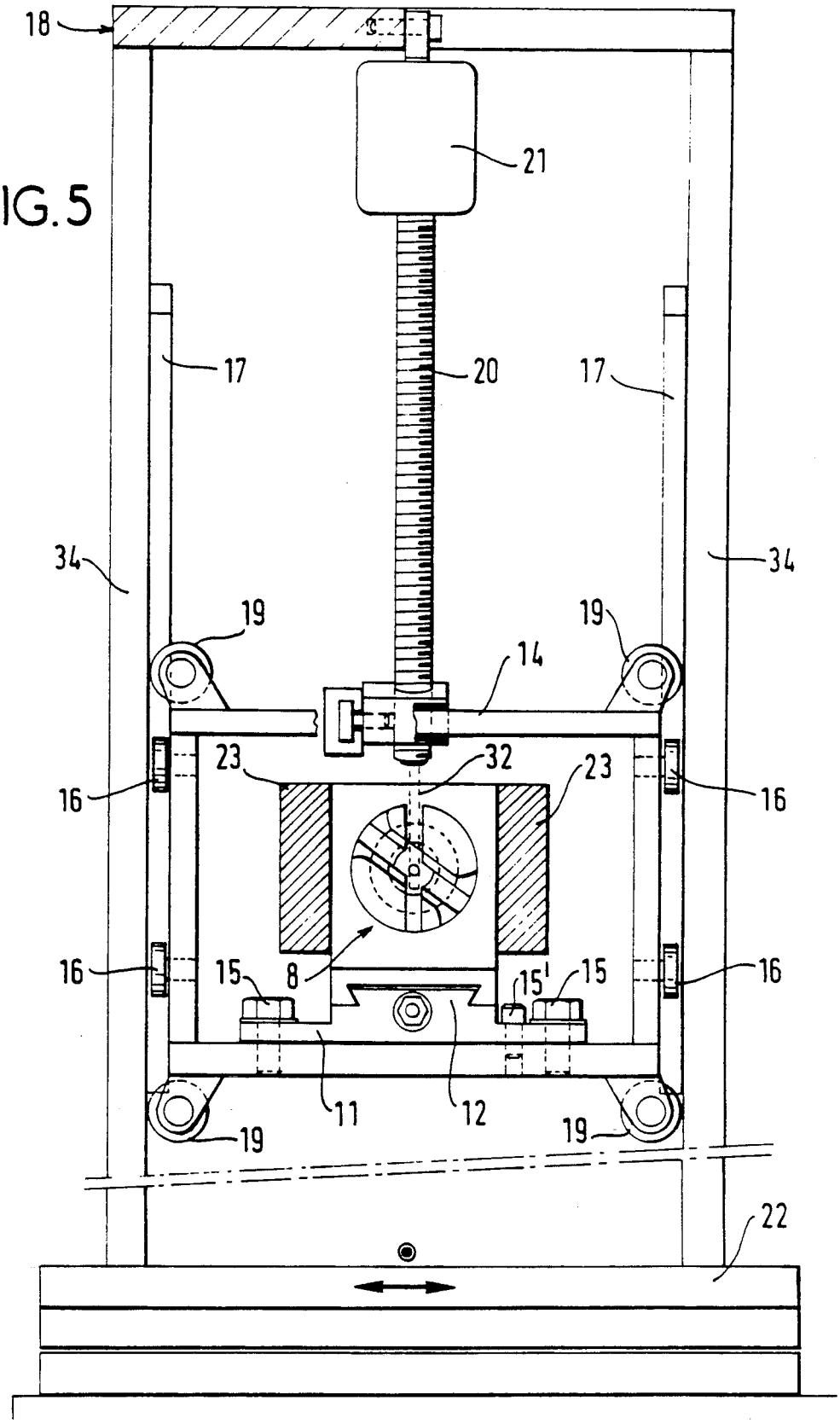
FIG. 5 is a front view of the device from FIG. 4.
Figure 6:
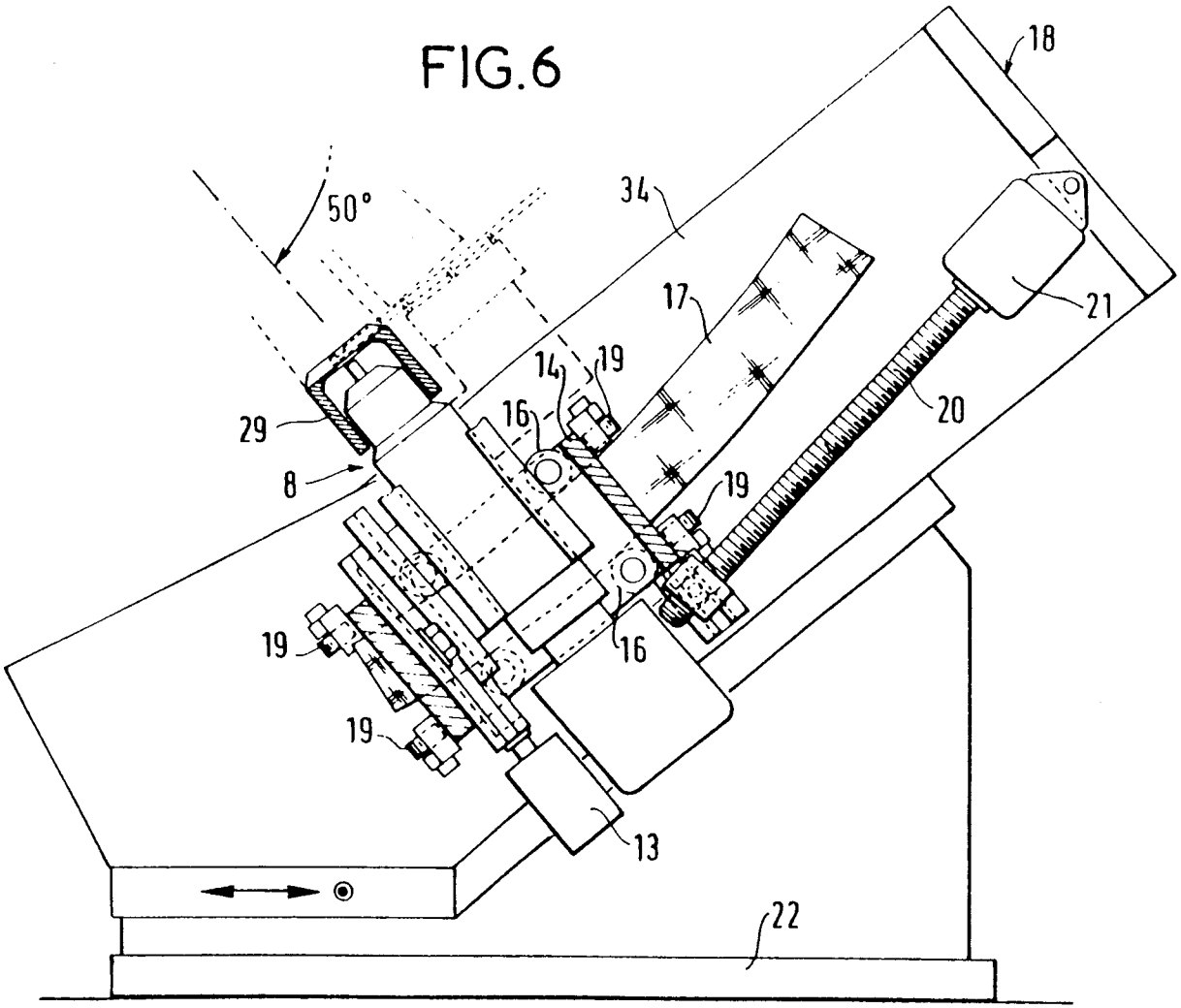
FIG. 6 shows a variant of the device from FIG. 3.

The rivetting device 8 (see FIGS. 3 through 5) includes a rivetting head 9 provided with a rivetting tool 10.

The rivetting head 9 is movable in translation parallel to its axis relative to a plate 11 on a slide 12 (see FIG. 4) by a motor 13.

The plate 11 can rotate about an axis perpendicular to the axis of the rivetting head 9 relative to a carriage 14. This axis is vertical in the device shown in FIGS. 3 through 5. The plate 11 is immobilized relative to the carriage 14 by two screws 15 and by two pins 15'.

The carriage 14 is fitted with rollers 16 which move on the edges of two vertical circular segments 17 fastened to two vertical uprights of a support 18. It also comprises rollers 19 which move on the surface of the vertical uprights 34.

The carriage 14 is moved by a lead screw 20 fixed at one end to the carriage 14 and at the other end to a motor 21 mounted on the support 18 by means of a balljoint.

The segments 17 are in vertical planes perpendicular to the axis of the rotor xx' so that the carriage 14 performs a circular movement parallel to the periphery of the rotor stage to which the shrouds 6 are fixed. The support 18 is mounted on a horizontal base 22 relative to which it can move horizontally in two directions, one parallel to the rotor axis and the other perpendicular to this axis.

The segments 17 have been chosen to suit a particular rotor stage and the support 18 has been positioned so that the axis of the segments 17 is coincident with the axis of the rotor.

The plate 11 is oriented so that the axis of the rivetting head 9 is at an angle c to the vertical plane P orthogonal to the axis of the rotor which is the same as the angle between the axis of the tenons 4 and this same plane.

Fixed to the rivetting head 9 are two flanges 23 each having an inclined flat end part 24.

The inclined parts 24 are parallel to the plane P and the flanges 23 are parallel to the axis of the rivetting head 9. The flanges 23 have been selected to suit the angle of inclination c of the tenons 4.

On the inclined part 24 of the flange 23 subject to the maximum load during rivetting is mounted a jaw 25 that can be moved parallel to the rotor axis by a motor 26. Mounted on the inclined part 24 of the other flange is a second jaw 27 movable parallel to the axis of the rotor by an actuator 28. The motor 26 and the transmission system totally immobilize the jaw 25 against axial displacement during rivetting despite the loads applied to it.

At the top of the rivetting head 9 are an end-piece 29 and an annular actuator 30 which moves the end-piece 29 parallel to the axis of the head 9.

The end-piece 29 is formed with an opening 31 through which pass the rivetting tool 10 and the tenons 4. Removable plates (not shown) are fixed to two edges of the opening to apply the shroud against the top of the blade to either side of the tenons.

The rivetting head 9 is a known head in which the rivetting tool 10 describes a rosette shape on applying a given force during rivetting and is moved forward before rivetting and retracted after rivetting.

In front of the rivetting tool 10 is mounted an endoscope 32 which can be retracted by an actuator 33 mounted on the rivetting head 9 by a linkage 35. The endoscope passes through the opening 31.

The method in accordance with the invention is as follows. The rotor is disposed with its axis horizontal. It is rotated to bring a group 2 of blades mounted on a rotor stage 7 of the rotor into a substantially horizontal position.

The tenons 4 on the blades are at an angle c to the vertical plane P of symmetry of the rotor stage of which the group 2 of blades forms part.

The two circular segments 17 corresponding to the rotor stage to which the shrouds 6 are to be mounted are then fitted. The support 18 of the carriage 4 is moved until the axis of the segments 17 is coincident with the axis of the rotor.

Two flanges 23 are mounted on the rivetting head 9. Each forms a dihedron with an obtuse angle of 180° - c. The position of the plate 11 is adjusted in rotation so that the axis of the rivetting head 9 is at an angle c to the plane P and so that the ends 24 of the flanges 23 are parallel to the plane P.

The endoscope 32 is adjusted on the axis of the head 9.

By moving the head by the motors 13, 21 and by moving the support 18 parallel to the axis xx' the endoscope is adjusted to the position of a tenon 4 on the horizontal blade. The axis of the rivetting head 9 is therefore aligned with the axis of the tenon 4.

When the rivetting head 9 has been adjusted for a tenon 4 horizontal and vertical movement of the rivetting head 9 is prevented by clamping devices (not shown). The jaw 25 is applied to a group of blades (five blades, for example) by operating the motor 26.

The other jaw 27 is applied to the same group of blades by the actuator 28 so as to clamp up the blades.

The end-piece 29 is placed against the shroud 6, the endoscope 32 being still in position.

The endoscope 32 is raised and the rivetting is carried out. The rivetting tool 10 comes into contact with the tenon 4 and moves concentrically with the periphery of the tenon 4 to flatten it. The duration and the force applied may be adjusted precisely to allow for the tenons used. The rivetting tool 10 is then moved automatically away from the tenon 4.

The shroud 6 is unclamped by retracting the endpiece 29. The group of blades is unclamped by moving away the jaws 27 and then 25; the rivetting head 9 is then unclamped to allow vertical and horizontal movement.

The endoscope 32 is replaced and centered on another tenon 4 to repeat the process.

The movement of the rivetting head 9 is simple on passing from one tenon of one blade to the corresponding tenon of another blade since they are in the same vertical plane; it is therefore sufficient to move the carriage 14 along the circular segments 17 to pass from one tenon 4 to another.

On passing from one tenon 4 of one blade to another tenon of the same blade it is necessary to move the support 18 laterally and to retract or advance the rivetting head along its axis.

In a variant of the invention the axis of the rivetting head 9 is not in a horizontal plane passing through the axis of the rotor (in which it can be moved by rotating the plate) but in a plane passing through the axis of the rotor and at an angle to the horizontal plane in the region of 45° to 90°.

In this way the loads applied by the rivetting device produce less deformation.

There is claimed:

1. Method of rivetting a shroud to a plurality of blades of a rotor stage of a horizontal axis rotor, each blade having a tip and comprising at said tip one or more tenons adapted to be inserted, respectively into one or more holes in the shroud, said tenons being at an acute angle c to the median plane of the rotor stage orthogonal to the rotor axis, said method comprising:

setting up a rivetting head for a specific rotor stage for movement in a circular manner in the vicinity of the tips of the rotor stage blades so that the rivetting head is over a tenon with the rivetting head axis alignable with the axis of the tenon, and then;

centering a first tenon in front of the rivetting head, clamping the head against vertical and horizontal movement, clamping together a group of blades including the blade to be shrouded by the rivetting head, clamping the shroud against the tip of the blade, rivetting the tenon, unclamping the shroud and the group of blades, unclamping the rivetting head to allow vertical and horizontal movement thereof, rotating the rivetting head to bring a second tenon in front of the rivetting head, and repeating the rivetting operations, and so on until all of the tenons of said shroud have been treated in this manner.

2. Method according to claim 1 wherein centering of said head on said tenon is effected by an endoscope carried by said rivetting head.

3. Device for rivetting a shroud to a plurality of blades of a rotor stage of a rotor to bind them together, each blade having a tip and comprising at said tip, one or more tenons adapted to be inserted into one or more holes respectively in said shroud, said tenons being at an acute angle c to the median plane P of the rotor stage orthogonal to the rotor axis, said device comprising: a carriage supporting a rivetting head, having a rivetting tool adapted to come into contact with the tenon and including means for moving said rivetting head about the axis of the head to rivet the shroud by flattening the tenon, the axis of the rivetting head being coincident with the axis of the tenon, the rivetting head being fastened to two flanges parallel to the axis of the rivetting head, each flange terminating in a part parallel to the plane P, each of these parts carrying a jaw and means for moving the jaws to immobilize a group of blades including the blade to which the shroud is to be rivetted.

4. Device according to claim 3 wherein said means for moving said jaws comprises a motor for moving one jaw and an actuator for moving a second jaw.

5. Device according to claim 3 characterized in that said carriage is provided with means enabling said rivetting head and said flanges to move backward and forward along said axis.

6. Device according to claim 3 wherein said rivetting head is mounted on said carriage by means of a rotatable plate for adjusting the angle of inclination of said rivetting head to a vertical plane perpendicular to the rotor axis to a value c equal to the inclination of said tenons relative to said vertical plane.

7. Device according to claim 3 wherein said rivetting head is provided with an end-piece and an actuator to apply said end-piece against said shroud to secure it during rivetting.

8. Device according to claim 3 wherein a support is provided with two circular guides along which said carriage moves in rotation, said guides having their axis coincident with the axis of the rotor which is horizontal and being removable so that the device can be adapted to suit the blades of each rotor stage.

9. Device according to claim 3 wherein said support is movable in two perpendicular directions relative to the ground.

10. Device according to claim 3 wherein the axis of said rivetting head lies in a plane passing through the axis of said rotor and at an angle to the horizontal plane of between 45° and 90°.

11. A device for rivetting a shroud to blades of a rotor stage of a horizontal axis rotor, each blade having a tip and comprising at said tip, one or more tenons adapted to be inserted into one or more holes respectively in the shroud, said tenons being at an acute angle c to the medium plane of the rotor stage orthogonal to the rotor axis, said device comprising means for setting up a rivetting head for a specific rotor stage so that said rivetting head can move in a circular manner in the vicinity of the tips of the rotor stage blades and so that when said rivetting head is over a tenon, the axis of said rivetting head is aligned with the axis of the tenon, means for centering a first tenon in front of the rivetting head, means for clamping the head against vertical and horizontal movement, means for clamping a group of blades including the blade to be shrouded by the rivetting head together, means for clamping said shroud against the tip of the blade, means for rivetting the tenon, and wherein repetitive rivetting operations are effected by unclamping the shroud and the group of blades after the tenon is rivetted, unclamping the rivetted head to allow vertical and horizontal movement thereof, moving the rivetting head to bring a second tenon in front of the rivetting head, and so on, until all of the tenons of a shroud have been treated in this manner.

* * * * *